United States Patent [19]

Knox et al.

[11] 4,286,640

[45] Sep. 1, 1981

[54] TAMPERPROOF PORT COVER

[75] Inventors: Kenneth H. Knox, Vernon Hills; Mark E. Larkin, Lindenhurst; James R. Duffield, Waukegan, all of Ill.

[73] Assignee: Abbott Laboratories, North Chicago, Ill.

[21] Appl. No.: 113,887

[22] Filed: Jan. 21, 1980

[51] Int. Cl.[3] ..... B65D 55/02

[52] U.S. Cl. ..... 150/8; 150/52 R; 215/249; 292/307 B

[58] Field of Search ..... 150/8, 52 R; 215/247, 215/249; 292/307 R, 307 B, DIG. 2; 24/249, 255 SL; 220/214

[56] References Cited

U.S. PATENT DOCUMENTS

| | | | |
|---|---|---|---|
| 122,396 | 1/1872 | McIlhenny | 292/307 B |
| 770,257 | 9/1904 | Brooks | 292/307 B |
| 968,759 | 8/1910 | Fogg | 292/307 B |
| 1,678,955 | 7/1928 | Rockenbauer | 292/307 B |
| 2,458,002 | 1/1949 | Kaskouras | 292/DIG. 12 |
| 3,311,396 | 3/1967 | Hotchkiss | 292/307 R |
| 3,380,267 | 4/1968 | Winchester | 292/307 R X |
| 3,888,377 | 6/1975 | Stadler | 215/249 |
| 4,068,696 | 1/1978 | Winchell | 150/8 |
| 4,176,756 | 12/1979 | Gellman | 215/274 |
| 4,187,893 | 2/1980 | Bujan | 150/8 |
| 4,241,188 | 12/1980 | Materia | 215/277 X |

FOREIGN PATENT DOCUMENTS

| | | | |
|---|---|---|---|
| 1538498 | 7/1968 | France | 24/255 SL |

*Primary Examiner*—Donald F. Norton

*Attorney, Agent, or Firm*—Robert L. Niblack; Neil E. Hamilton

[57] ABSTRACT

A tamper resistant cover for the port of a container for medical liquids which when applied to the port indicates that an additive material has been introduced into the container. The port cover is easily molded from a resinous plastic material and includes latch portions which fit into a latch bar with the latch bar serving as a means to prevent access with the latch portions so as to result in a tamper-resistant structure. Preferably, the latch portions are in the form of barbed sections and are guided by means of an inclined ramp into latch openings in such a manner that a compression fit is provided so that after the barbed sections are forced through the latch openings the barbed sections will expand to engage latch surfaces in the latching bar.

13 Claims, 6 Drawing Figures

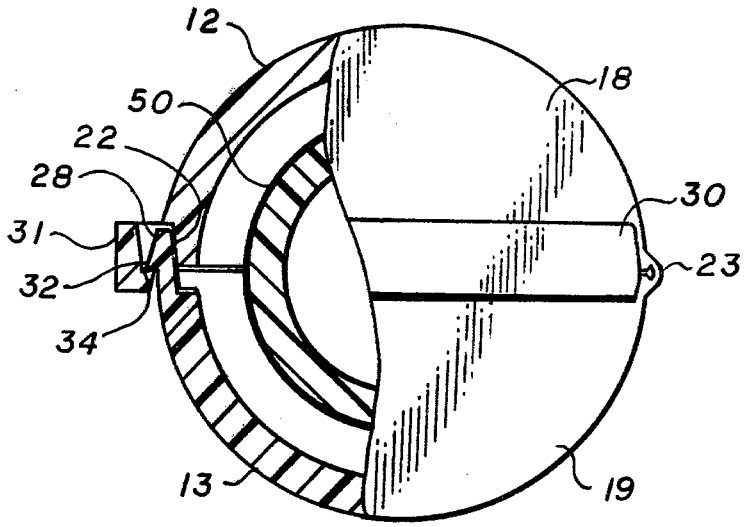
FIG. 3
FIG. 5
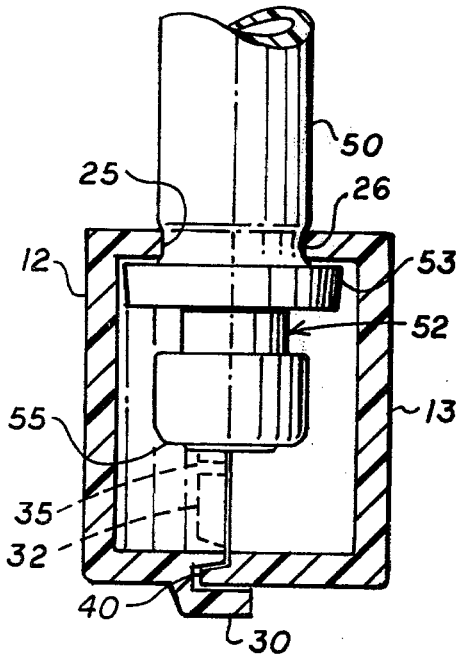
FIG. 4
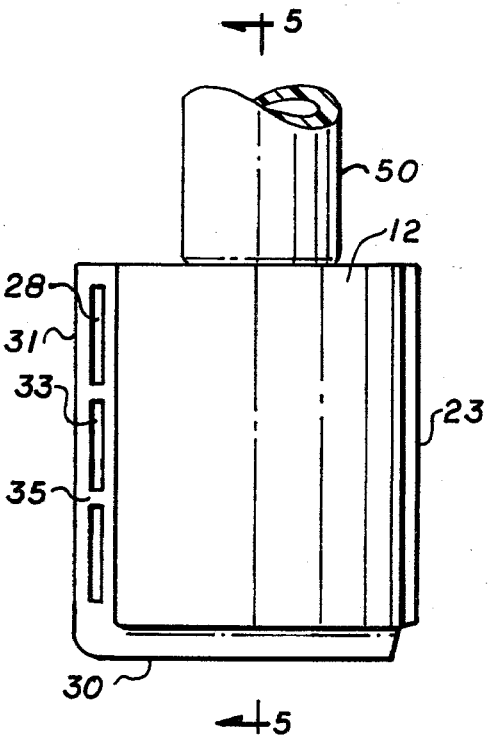

TAMPERPROOF PORT COVER

BACKGROUND OF THE INVENTION

This invention relates to a tamper-resistant cover for a port member of a medical liquid container. More particularly, it relates to a unitary and hinged cover member for the port of an I.V. liquid container wherein the cover unit will completely surround the tubular port in a manner such that it is extremely difficult to open the cover member so that the cover member will indicate that an additive material has been made to the solution container and thus will prevent subsequent additions from being made.

Locking devices of the type concerned with in this invention are described in U.S. Pat. Nos. 122,396; 770,257; 968,759; 1,678,955; 2,458,002; 3,311,396 and 3,380,267. All of the prior art devices describe locktype units for preventing unauthorized contact with items such as pipe couplings, doorknobs and speedometers. Accordingly, nowhere in the prior art is there described a port cover member for a medical liquid container which will engage the flexible tubular wall of the port and be retained thereon in a manner so as to prevent subsequent access to the port.

It is an advantage of the present invention to provide a novel tamper-resistant cover for the port of an I.V. liquid container. Other advantages are a tamper-resistant port unit which is easily molded; has means for preventing the opening of the cover member once it is activated to a closed position; utilizes latch portions with barbed ends which are guided into engagement with latch surfaces and are held therein by a compression fitment between the barbed surfaces and the latch openings as well as the biasing force of the tubular engaging section of the cover member engaging the resilient tubing.

SUMMARY OF THE INVENTION

The foregoing advantages are accomplished and the shortcomings of the prior art are overcome by the protective cover of this invention for the port of a container for medical liquids wherein the port cover is composed of first and second body members defining side and opposing end walls adapted to partially surround said port side and end wall. Hinging means extend between the adjacent wall portions of said first and second body members to interconnect them. The first and second body members have opposing end walls, each adapted to partially surround said port side and end wall. Hinging means extend between the adjacent wall portions of said first and second members to interconnect them. The body members have opposing end walls presenting port engaging surfaces at one end of each member and a closed wall at the other end. Frictional engagement means are disposed adjacent the wall portions of the body members opposite the hinging means to provide a snap-fit arrangement. The port engaging surfaces and the frictional engaging means are arranged so that when the body members are placed over the side and end walls of the port and the frictional engagement means are activated, the resilient side wall of the port will exert a biasing force on the port engaging surface to maintain the frictional engagement means under tension. In a preferred manner, the frictional engagement means includes a bar member extending from the exterior surfaces of the side wall of one of the members to prevent access to the frictional engagement means. Also in a preferred manner, the frictional engagement means is defined by latch portions having barbed surfaces extending from one of the first or second members and latch surfaces provided on the other member for engagement by the barbed surfaces in a compressive manner.

BRIEF DESCRIPTION OF THE DRAWINGS

A better understanding of the tamper-resistant cover of this invention will be afforded by reference to the drawings wherein:

FIG. 3 is a top view with a portion broken away illustrating the protective cover member as it would engage and surround the port of a container.

FIG. 4 is a view in side elevation showing the protective cover engaging the port of a medical liquid container.

FIG. 5 is a view in vertical section taken along line 5—5 of FIG. 4 showing the unit turned 90°

DESCRIPTION OF THE PREFERRED EMBODIMENT

Figure 1:
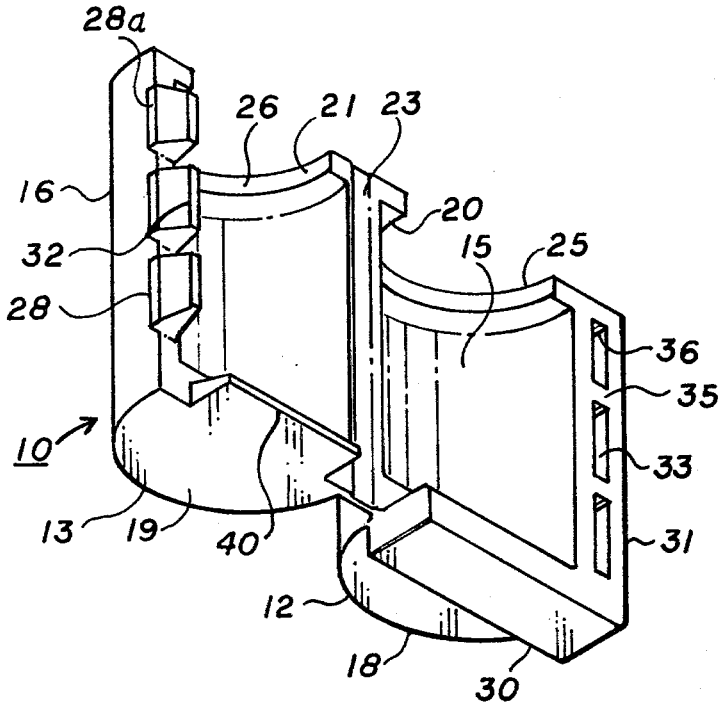
FIG. 1 is a perspective view of the protective cover in a condition after it would be molded and prior to activation.

The protective cover generally 10 as shown in FIG. 1, includes first and second hemicylindrical body members 12 and 13 respectively, each having a side wall 15 and 16, respectively, as well as respective end walls 18, 19,20 and 21. A hinging section 23 interconnects the body members while port engaging surfaces 25 and 26 extend from end walls 20 and 21. Extending from side wall 16 opposite hinging section 23 are latch portions 28 with barbed sections 32 which are of a uniform dimension with spacing therebetween. Extending from the end wall 19 and opposite the port engaging surface 26 is a ledge portion 40. Projecting from end wall 18 member 12 is a bar 30 under which ledge portion 40 will fit. Coextensive with bar 30 is latch bar 31 which also contains latch openings 33 for frictionally receiving latches 28 extending from side wall 16.

Figure 2:
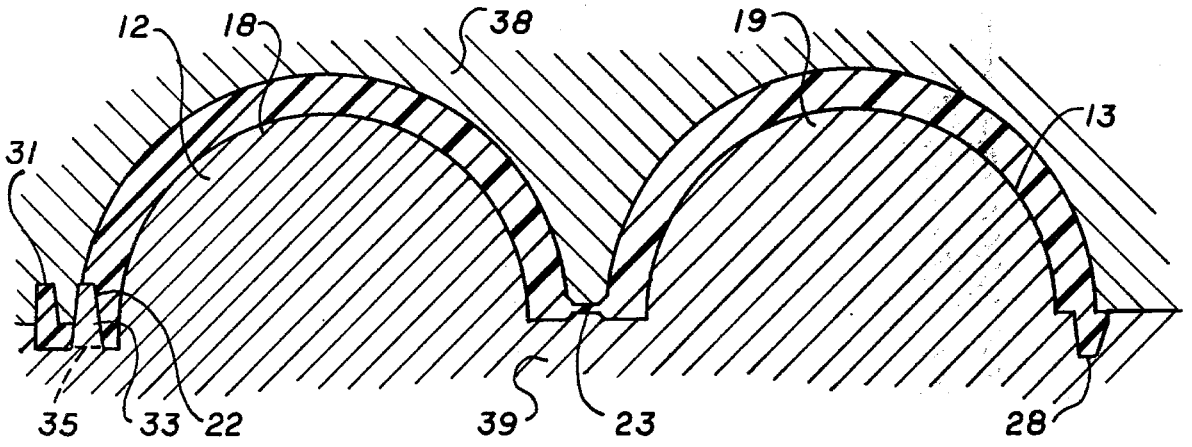
FIG. 2 is a top plan view illustrating the protective cover as it would be molded.

Referring to FIG. 2, it will be seen that the first and second body members 12 and 13 are easily molded in mold sections 38 and 39 such that the part can be molded with a straight pull mold. Accordingly, no cammed side core action is required. This is true even though latch openings 33 will be formed between ribs such as 35 in latch bar 31.

As best indicated in FIG. 3, the barbed section 32 of latch portion 28 will be captured and retained by latch bar 31 through engagement of the barbed section 32 with a latch surface 34. The barbed section 32 will be guided into the latching contact by means of an inclined ramp surface 36 which forms the end wall of opening 33 adjacent port engaging surface 25 and a latch surface 34. (See also FIG. 1.) Ramp surface 36 thereby forms a portion of the frictional engagement means.

FIGS. 4 and 5 illustrate the positioning of the protective cover over the port 50 of a container for medical liquids. As best seen in FIG. 5, the bag port will have the usual reseal unit 52 secured inside bag port 50 with a flange 53 extending therefrom and a rubber reseal 55 secured to the end of the reseal unit 52. Members 12 and 13 with port engaging surfaces 25 and 26 are so constructed so that when latch portions 28 with barbed sections 32 engage latch bar 31 a slight compressive force will be exerted on the bag port 50 so that a resilient tension is effected on the latch engagement. At the same time bar member 30 extending from end wall 18 will frictionally receive ledge 40 to provide additional frictional engagement means.

ALTERNATIVE EMBODIMENT

Figure 6:
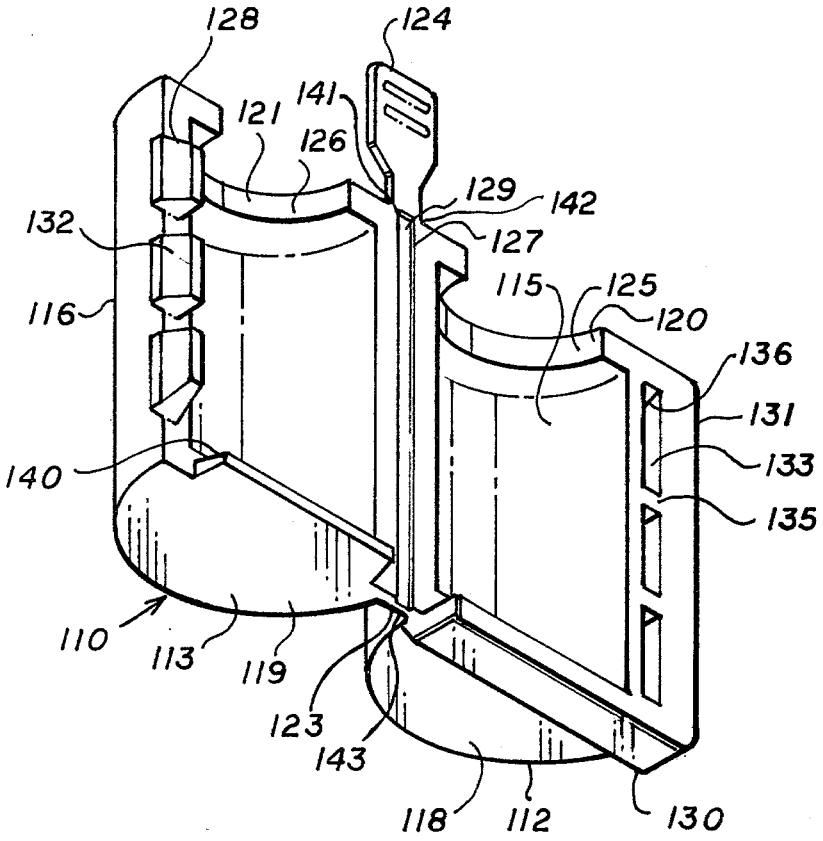
FIG. 6 is a view similar to FIG. 1 except showing an alternative embodiment.

FIG. 6 represents an alternative embodiment of the protective cover with similar numbers in the "100" series being used to illustrate similar parts as in device 10. The main difference between covers 10 and 110 is in the provision of a hinge section 123 between first and second members 112 and 113 which is removable. It will be noted that the hinge section 123 is defined by and made removable by means of a rectangular portion 129 which is disposed parallel with the longitudinal axis of hinge 123. A tear tab 124 is connected to the hinge section 123 for purposes of tearing away the hinge section 123 from first and second members 112 and 113.

OPERATION

A better understanding of the advantages of the protective covers 10 and 110 will be had by a description of their operation. Referring to cover 10 first, an I.V. solution container will be supplied having a port 50 with a reseal unit 52 formed as an integral part thereof. When it is desired to place an additional medicinal material inside the bag the reseal plug 55 will be pierced by the needle of an additive container and the contents forced into the port 50 and the solution container. After the additive material is introduced, it is necessary to indicate to anyone concerned with the administration of I.V. fluids that an additive material has been placed in the solution container. Accordingly, the protective cover 10 serves as such an indicator means. The protective cover 10 will be supplied as shown in FIG. 1. After the previously indicated addition has been made, the tube gripping flanges 25 and 26 will be placed inwardly and adjacent the annular flange 53 of the reseal unit 52. The first and second members 12 and 13 will be brought together in a manner so that the latches 28 extending from side wall 16 will pass through latch openings 33 of latch bar 31 and at the same time ledge portion 40 extending from end wall 19 will pass inside bar 30. The latch portions 28 will be guided into and held in frictional engagement with latch openings 33 of latch bar 31 by means of the inclined ramp 36 located adjacent port engaging surface 25. The engagement of latch portion such as 28*a* with ramp 36 will effect a slight downward movement (as best seen in FIG. 1) of ledge portion 40 extending from end wall 19 into engagement with bar 30. Once the barbed sections 32 of the latch portions 28 pass through the openings 33, they will be captured therein by means of latch surfaces 34 and engagement with wall surface 22. This is best seen in FIG. 3. As previously explained, the barbed sections 32 will also be aided in their latching contact by the resilient contact and biasing effect of port engaging surfaces 25 and 26. This is indicated in FIG. 5.

The operation of cover unit 110 is basically similar to that described for unit 10 except that in those cases where it is desirable to remove unit 110 from a bag port 50, all that is required is to exert a pulling force on tab 124. This will effect a tearing away of hinge portion 123 at break points such as 141, 142 and 143 so as to make first and second members readily removable from port 50.

An important feature of protective covers 10 and 110 is the fact that once the latch portions 28 and 128 pass in through the openings 33 and 133 of the latch bars 31 and 131 and the barbed sections engage the latch surfaces 34 and corresponding surfaces in latch bar 131, the barbed surfaces cannot be contacted as they will be covered by the outer wall surface of the latch bars 31 and 131. This is best indicated in FIGS. 3–5. At the same time, the resilient and biased latching engagement is also provided as previously explained. Accordingly, a tamper-resistant unit is provided which can be molded in a simplified manner yet can be readily engaged and, by the described interengagement, is effected and extremely resistant tamperproof cover.

The preferred molding technique for fabricating protective covers 10 and 110 is injection molding. The preferred materials for fabricating the protective covers is polypropylene. However, other materials such as polyethylene, ABS or other engineering thermoplastics could be employed.

It will thus be seen that through the present invention there is now provided a unitary and disposable protective cover member which is easily fabricated yet is readily activated. The unitray cover member provides a highly tamper-resistant unit, yet the protective cover can be manufactured with a minimum amount of cost.

The foregoing invention can now be practiced by those skilled in the art. Such skilled persons will know that the invention is not necessarily restricted to the particular embodiments presented herein. The scope of the invention is to be defined by the terms of the following claims as given meaning by the preceding description.

I claim:

1. A protective cover for the port of a container for medicinal liquids, said port defining flexible side and end walls comprising:

first and second body members defining side and opposing end walls adapted to partially surround said port side and end wall;

hinging means extending between adjacent wall portions of said first and second members to interconnect said members;

said first and second body members defining oppposing end walls presenting port-engaging surfaces at one end of each said member and a closed wall at the other end;

tamperproof frictional engagement means operatively associated with adjacent wall portions of said first and second body members opposite said hinging means providing a snapfit arrangement;

said port engaging surfaces and said frictional engagement means of said first and second body members constructed and arranged so that when said first and second members are placed over said side and end walls of said port and said frictional engagement means are activated, said resilient side wall of said port will exert a biasing force on said port engaging surface to maintain said frictional engagement means under tension.

2. The protective cover as defined in claim 1 wherein said frictional engagement means includes bar members extending from the exterior surfaces of said side and end walls of one of said first or second members to prevent access to said frictional engagement means.

3. The protective cover as defined in claim 2 wherein said frictional engagement means is defined by latch portions having barbed surfaces extending from one of said first or second members and latch surfaces provided on the other of said first or second body member for engagement by said barbed surfaces.

4. The protective cover as defined in claim 3 further including a ramp surface positioned adjacent said latch surfaces on a wall portion of one of said first or second body members opposite said hinging means to guide said barbed surfaces into engagement with said latch surfaces.

5. The protective cover as defined in claim 4 wherein said ramp surface provides a portion of said frictional engagement means.

6. The protective cover as defined in claim 5 wherein said latch portions with said barbed surfaces are of a uniform dimension with spacing therebetween and said frictional engagement means include rib members extending from said bar members to said side walls.

7. The protective cover as defined in claim 1 wherein said hinging means further includes a weakened portion to provide for said hinging means to be torn away.

8. The protective cover as defined in claim 7 wherein said hinging means further includes a tear tab for removal of said hinging means.

9. A unitary two component protective cover for a tubular port of a container for medicinal liquids, said port defining a flexible side wall comprising:

two substantially hemicylindrical members defining side walls, opposing pairs of end walls one said pair of end walls presenting a substantially closed surface when overlapped and opposing tubular engaging portions in the other pair of said end walls;

a web-like hinging portion extending between adjacent wall portions of said two hemicylindrical members;

frictional engagement means positioned adjacent the edges of said side walls opposite said hinging portion;

tamperproof means operatively associated with said frictional engagement means to prevent access to said frictional engagement means after engagement;

said opposing tubular engaging portions and said frictional engagement means of said two hemicylindrical members constructed and arranged so that when said members are placed over said side and end walls of said port and said port and said frictional engagement means are activated, said flexible side wall of said port will exert a biasing force on said tubular engaging portions to maintain said frictional engagement means under tension.

10. The protective cover as defined in claim 9 wherein said port of said container includes a flange and said tubular engaging portions are constructed and arranged to surround said flange.

11. The protective cover as defined in claim 10 wherein said frictional engagement means is defined by barb members extending from one of said members and latch members extending from the other of said members for operative engagement.

12. The protective cover as defined in claim 11 wherein said other member with said latch members further includes a ramp structure positioned adjacent the edge of said side wall constructed and arranged to guide said barb members into engagement with said latch members.

13. The protective cover as defined in claim 12 wherein said hemicylindrical members, said frictional means and said tamperproof means are composed of a thermoplastic material.

* * * * *